United States Patent [19]

Ulrich et al.

[11] 4,137,966

[45] Feb. 6, 1979

[54] SIMULATION OVEN

[75] Inventors: Richard D. Ulrich, Provo, Utah; Crill Maples; Howard C. Schafer, both of Ridgecrest, Calif.

[73] Assignee: The United States of America as represented by the Secretary of the Navy, Washington, D.C.

[21] Appl. No.: 788,725

[22] Filed: Apr. 19, 1977

[51] Int. Cl.[2] ..... F25B 29/00; F24C 15/24; F27B 3/20

[52] U.S. Cl. ..... 165/30; 73/15 R; 165/61; 165/169; 432/18; 432/31; 432/175; 432/225; 165/48 R

[58] Field of Search ..... 165/30, 48, 61, 169, 165/171; 73/15 R, 15 B; 432/18, 175, 225, 266, 31

[56] References Cited

U.S. PATENT DOCUMENTS

| | | | |
|---|---|---|---|
| 2,828,813 | 4/1958 | Holden | 432/175 |
| 2,895,544 | 7/1959 | Parsons | 432/175 |
| 3,358,979 | 12/1967 | Flynn | 432/175 |
| 3,722,866 | 3/1973 | Herzberg | 432/175 |
| 3,825,406 | 7/1974 | Heath | 432/175 |

*Primary Examiner*—Ronald H. Lazarus
*Assistant Examiner*—Sheldon Richter
*Attorney, Agent, or Firm*—R. S. Sciascia; W. T. Skeer; K. G. Pritchard

[57] ABSTRACT

An oven with temperature-independent sections permits objects placed within it to experience the uneven heating and temperature gradient problems associated with real life conditions. The number of sections can vary depending on the gradients desired.

5 Claims, 6 Drawing Figures

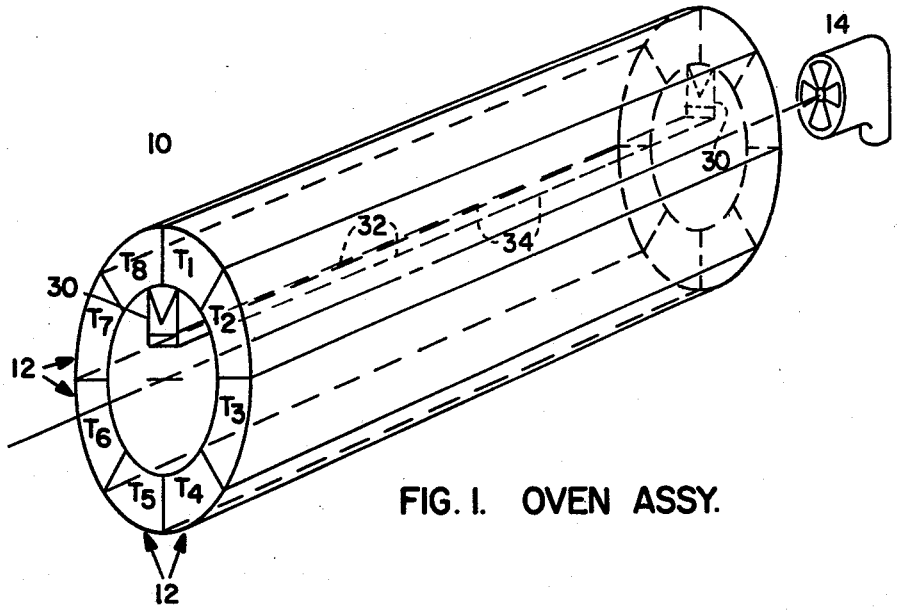
FIG. 1. OVEN ASSY.
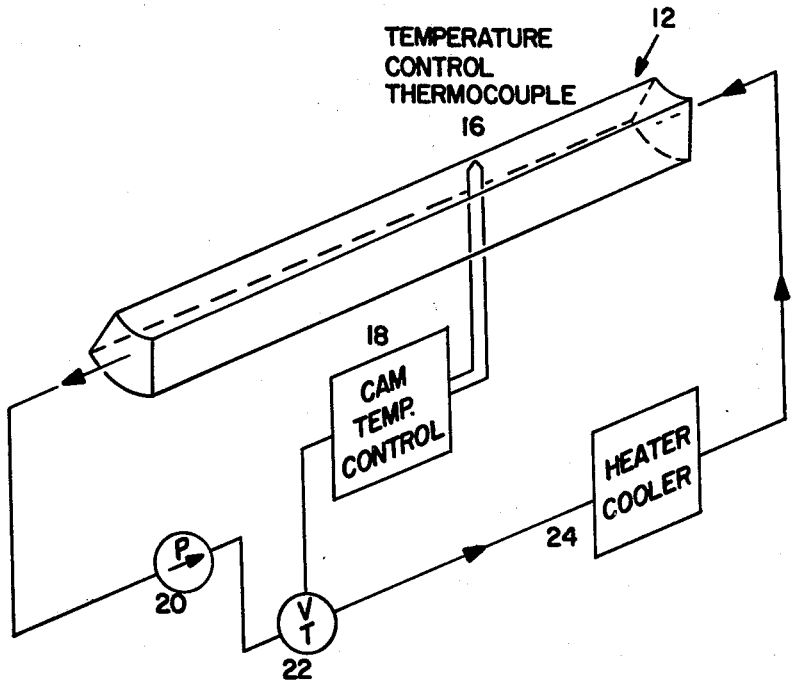
FIG. 2. SINGLE SEGMENT AND UTILITY SCHEMATIC

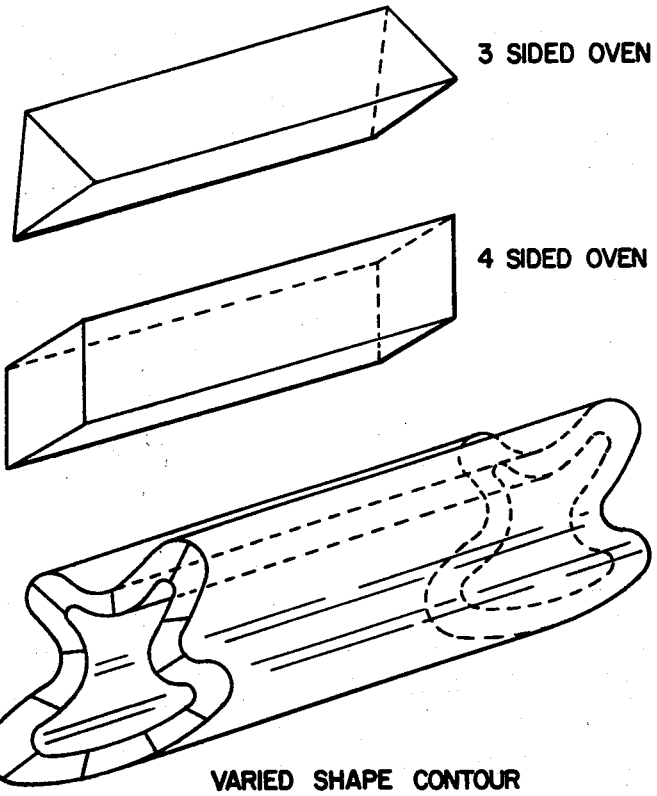
TYPICAL POSSIBLE OVEN SHAPES
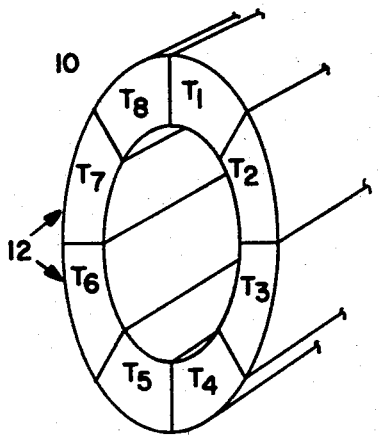
| T | SITUATION A | SITUATION B | SITUATION N |
|---|---|---|---|
| $T_1$ | HOT | HOT | COLD |
| $T_2$ | WARM | HOT | COLD |
| $T_3$ | TEPID | WARM | COOL |
| $T_4$ | COLD | TEPID | WARM |
| $T_5$ | COLD | COLD | WARM |
| $T_6$ | TEPID | COLD | COOL |
| $T_7$ | WARM | TEPID | COOL |
| $T_8$ | HOT | WARM | COLD |
TABLE 40
FIG. 4. VARIABLE THERMAL GRADIENT

SIMULATION OVEN

BACKGROUND OF THE INVENTION

This invention relates to heating enclosures such as ovens. In particular it pertains to heating sources designed to produce temperature gradients across objects placed within such enclosures. In even greater particularity this invention is designed to produce such gradients by either radiation and/or convection.

Ovens have been used in the past to simulate weathering and ageing problems. Past ovens have been essentially convection ovens controlled by a single temperature location on the item.

Many items that are subject to field conditions have their useful life limited by the unevenness of heating and cooling which produce temperature gradients within the item. Among the many thermal sources effecting an object outdoors are sun, sky, clouds, wind, ground radiation, reflected solar radiation, and so forth. The net effect of these thermal forcing functions are temperature gradients throughout the object.

Furthermore, these gradients are rarely stable since the thermal sources are subject to constant change, the sun angle constantly changes, the wind fluctuates, and so forth. Thus to adequately field test items, simulation ovens have to be capable of providing different heat sources from different angles.

SUMMARY OF THE INVENTION

The present invention provides a way to induce variable temperature gradients in objects equal to those found in field conditions. The simulation oven is divided into as many heating sections as desired. Each section contains a temperature monitoring system which in turn regulates the relative temperature of each section as compared to the others.

The temperature monitoring system includes either a cam temperature control or other form of automatic temperature selection so that variable heating and cooling effects can be duplicated.

The use of at least one blower permits convection heating effects to be duplicated in addition to the radiation effects from the heating sections.

An object of this invention is to provide an oven with relative temperature control around an object within the oven. A further object is to duplicate the same relevant temperature gradients in the object that would occur in actual field conditons. Another object of the invention is to provide a simulation oven capable of both radiation and convection heating effects.

BRIEF DESCRIPTION OF THE DRAWINGS

FIG. 1 is a drawing of the present invention with eight sections;

FIG. 2 is a drawing of an individual heating section including a temperature monitoring system and a heater-cooler system;

FIGS. 3A 3B and 3C are examples of other possible oven configurations; and

FIG. 4 is a partial table of a test scenario for the eight section oven shown in FIG. 1.

DESCRIPTION OF THE PREFERRED EMBODIMENT

FIG. 1 shows an oven enclosure 10 which is divided into individual heating sections 12. In this particular drawing eight (8) such sections are shown and are labelled $T_1$ through $T_8$. Forced air convection through the oven can be created by any suitable device such as blower 14.

FIG. 2 shows an individual heating section 12 which is the thermal radiator from which the item under test derives its temperature. Heating section 12 can be shaped to allow as many or as few panels as desired in an oven. The encasing material can be any suitable material for the actual temperature range desired. Temperature in the heating section 12 is sensed by thermocouple 16. The output of thermocouple 16 is fed to temperature control 18 forming a temperature monitor.

A working fluid such as oil is driven by pump 20 through the heating section 12. Throttle valve 22 is regulated by temperature control 18. To produce gradient variations such as diurnal cycles, temperature control 18 can be a cam drive or other timed sequence control in addition to temperature regulator for a predetermined level. Of course the actual gradient variations are due to the combined effects of adjoining sections. The oil is pumped through heater-cooler 24 for temperature stability.

In an alternative embodiment, not shown, heater-cooler 24 can be regulated directly by temperature control 18.

FIG. 3A, 3B and 3C show other forms possible for different numbers of heating sections 12. FIG. 3A is triangular, FIG. 3B rectangular, and FIG. 3C emphasizes the wide range of configurations possible to cover the possible effects that can be studied.

FIG. 4 is an example of what has been discussed above. Referring back to FIG. 1, oven enclosure 10 with eight (8) heating sections 12 labelled $T_1$ through $T_8$, a table 40 is provided with relative temperature conditions, HOT to COLD, for the heating sections 12.

Since it is the temperature gradient which is important vice the actual temperature, each situation from A to N is given relative to the heating sections 12 of the enclosure. In situation A, $T_1$ and $T_8$ are the hottest while $T_4$ and $T_5$ are the coldest. This is similar to the temperature an item sitting on the ground would experience shortly after sunrise, with $T_1$ and $T_8$ being the top and $T_4$ and $T_5$ the bottom. Situation B would then correspond to a slightly later time. This progression would continue until situation N which corresponds to a time just before sunrise.

Actual location of items in the oven can be varied by any of the well known methods of support. In general, suspension in the center of enclosure 10 is the easiest to control, however, additional variations in gradients can be achieved by varying position within enclosure 10.

One method of support is shown in FIG. 1. Brackets 30 support a two rail track 32 which runs the length of the oven. A tray 34 slides on track 32 and holds items to be heated. The length of brackets 30 can be varied, permitting an item to be placed anywhere in the oven.

What is claimed is:

1. An oven for creating thermal gradients comprising:
   - a plurality of heating sections joined together forming an enclosure;
   - a plurality of temperature monitors distributed with at least one of said temperature monitors in each of said heating sections and mounted so as to measure the heat level therein;
   - a plurality of heating-cooling systems with at least one attached to each heating section so as to control the temperature therein and which is itself controlled by the temperature monitor for that heating section and where said heating-cooling systems contain a working fluid of oil which is suitable for causing radiation heating from said heating sections and is temperature controlled by a closed-loop feed back system; and at least one blower positioned for inducing convection air flows over items placed in the oven.

2. An oven as described in claim 1 where the temperature monitors are thermocouples operatively attached to cam temperature controls which in turn regulate the heating-cooling system.

3. An oven as described in claim 1 where the plurality of heating sections is eight.

4. An oven as described in claim 1 which further comprises suspension means for supporting items to be heated in the oven, said means capable of supporting an item in a variety of positions within the oven.

5. An oven for creating thermal gradients comprising:

a plurality of heating sections joined together forming an enclosure for radiative heating;

a plurality of thermocouples distributed with at least one in each of said heating sections for monitoring the heat level in each of said sections;

a working fluid of oil for circulating through said heating sections and serving as a heat source or sink;

a plurality of heating-cooling systems with at least one attached to each heating section so as to control the temperature therein by pumping said working fluid through said heating sections and which is itself controlled by the thermocouple monitoring the heat level in that section;

at least one blower positioned for inducing convection air flows over item placed in said oven;

suspension means for supporting items to be heated in said oven, said means capable of supporting an item in a variety of positions within said oven so that temperature gradients can be induced in said item by radiation from various heating patterns in said heating sections; and a cam temperature control attached to said thermocouples and to said heating-cooling system for regulating said system.

* * * * *